United States Patent [19]

Waterbury

[11] 4,232,797

[45] Nov. 11, 1980

[54] RECLOSABLE CONTAINER

[76] Inventor: Nelson J. Waterbury, 211 E. 70th St., New York, N.Y. 10021

[21] Appl. No.: 38,948

[22] Filed: May 14, 1979

Related U.S. Application Data

[63] Continuation-in-part of Ser. No. 908,141, May 22, 1978, Pat. No. 4,164,303.

[51] Int. Cl.[3] ..... B65D 39/12; B65D 41/32

[52] U.S. Cl. ..... 220/359; 220/260; 220/269; 220/307; 220/339

[58] Field of Search ..... 220/269, 260, 359, 339, 220/336, 307, 265; 222/281, 282; 229/7 R

[56] References Cited

U.S. PATENT DOCUMENTS

| | | | |
|---|---|---|---|
| 3,952,911 | 4/1976 | Bozek et al. | 220/269 |
| 4,077,538 | 3/1978 | Waterbury | 220/269 X |
| 4,122,970 | 10/1978 | Amabili | 220/336 X |
| 4,164,303 | 8/1979 | Waterbury | 220/359 |

*Primary Examiner*—George T. Hall

*Attorney, Agent, or Firm*—Brumbaugh, Graves, Donohue & Raymond

[57] ABSTRACT

A container having an articulated closure for an opening in the lid in which one end of the closure is mounted on the lid adjacent the inner end of the opening, a closure element is hinged to the mounted end and overlies the opening to seal the contents and a lift element is integrally formed on the closure element opposite the mounted end to lift the closure element pivotally relative to the mounted end to provide access to the opening for the discharge of the contents of the container.

6 Claims, 16 Drawing Figures

FIG. 4
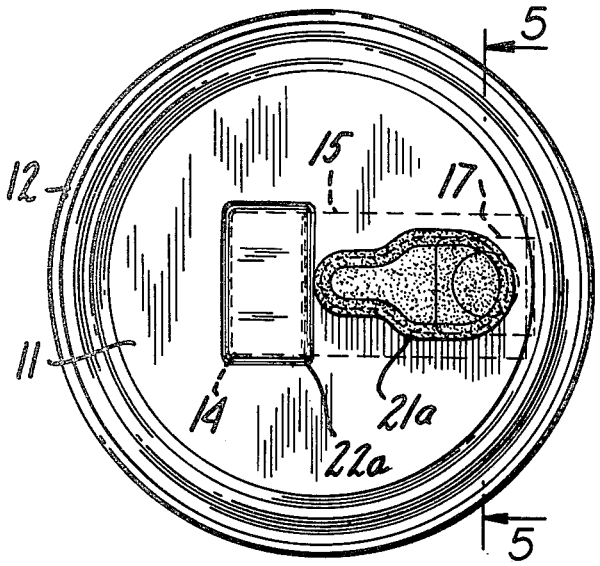
FIG. 5
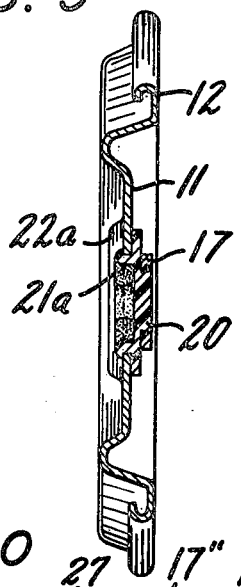
FIG. 10
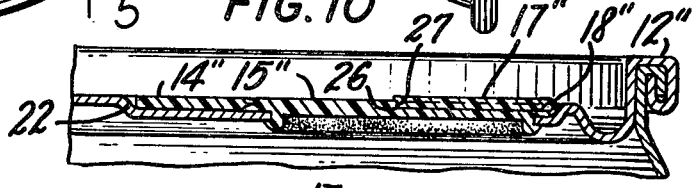
FIG. 6
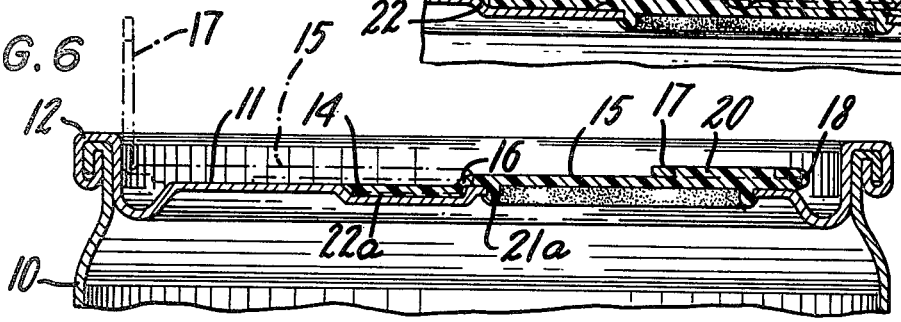
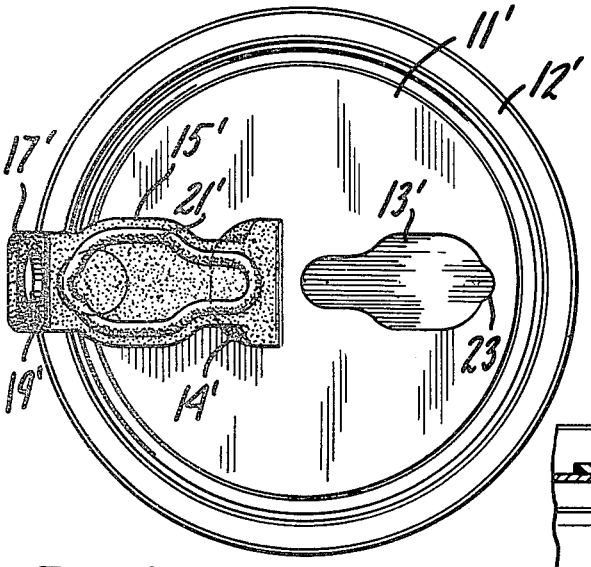
FIG. 7
FIG. 8
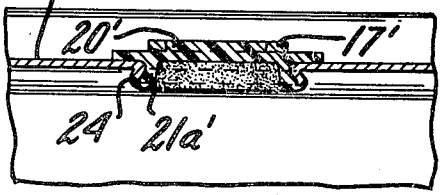
FIG. 9
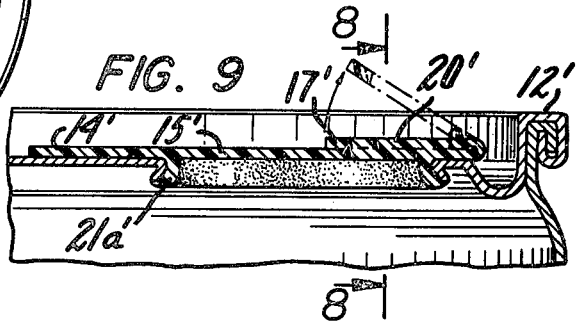

RECLOSABLE CONTAINER

This is a continuation-in-part of my copending application, Ser. No. 908,141, filed May 22, 1978, now U.S. Pat. No. 4,164,303, issued Aug. 14, 1979.

This invention relates to containers, for example, sealed containers of the type to vend foods, beverages, motor oil and other products and, more particularly, to an improved easy-to-open closure for a container of that type which is safe to use and does not have any part which in normal use is separated from the lid to be discarded or dropped into the container.

Containers having flip-top tab closures have long been in widespread use, but they are presently in disfavor because the removable tabs are indiscriminately discarded, presenting an environmental problem. They have other disadvantages, such as sharp edges which can cut the skin, a difficult-to-lift ring that can damage finger nails and a removable tap which can be dropped into the opening of the container and accidentally swallowed. In many jurisdictions flip-top tab closures have been outlawed.

Containers having push-in tabs have been proposed to overcome the environmental problem of flip-top tabs, but they possess all of the other disadvantages of flip-top tabs and introduce a new problem of possible contamination of the contents, a problem of particular concern where the containers are stored in rat-infested basements.

The container of the present invention overcomes these disadvantages and provides an inexpensive, vendable, air-tight container closure which can be easily opened without injury to the user and, in its preferred embodiment, resealable to store the unused contents.

The present invention provides an articulated closure for the container which is pivotally mounted on the lid to dispense the contents from the container, and in its open position remains on the lid and cannot be discarded or dropped back into the container through the opening. It has no sharp edges, there is no debris to discard apart from the container and there is no danger that the closure will be swallowed accidentally by the user.

The articulated closure is mounted at one end to the lid of the container adjacent the inner end of an opening in the lid, a closure element is hinged to the mounting end for sealing the opening and a lift element is integrally formed on the closure element opposite the mounted end for pivotally lifting the closure element to an upright position relative to the mounted end to provide access to the opening. In the preferred embodiment of the closure, the underside of the closure element has a depending seal formed thereon of complementary shape to the opening to enable the closure to be reclosed for the storage of the unused contents of the container.

The lift element normally overlies the closure element, and it is liftable relative to the closure element so that the seal can be broken, commencing with the end remote from the mounting end. The closure can have provision for holding the lift element in folded-back relation against the upper surface of the closure element in the sealed condition, and the container can have provision for holding the closure element in folded-back position against a storage area on the lid in open condition.

For a complete understanding of the present invention, reference can be made to the detailed description which follows and to the accompanying drawings, in which:

FIG. 4 is a view of a closure similar to FIGS. 1 and 2 shown from the underside of the lid and without the recess in the lid for the closure element;

FIG. 5 is a cross-sectional view taken along the line 5—5 of FIG. 4 looking in the direction of the arrows;

FIG. 6 is a longitudinal cross-sectional view of the closure shown in FIG. 4;

FIG. 7 is a plan view of still another embodiment of the closure;

FIG. 8 is a transverse cross-sectional view of the closure shown in FIG. 7 in sealed condition, that is to say, a view along the line 8—8 of FIG. 9 looking in the direction of the arrows;

FIG. 9 is a longitudinal cross-sectional view of the closure shown in FIG. 7 in sealed condition;

FIG. 10 is a cross-sectional view of a further embodiment showing the mounting and closure elements of the articulated closure recessed in the lid and the lift element folded back on the closure element and partially recessed therein;

Figure 11:
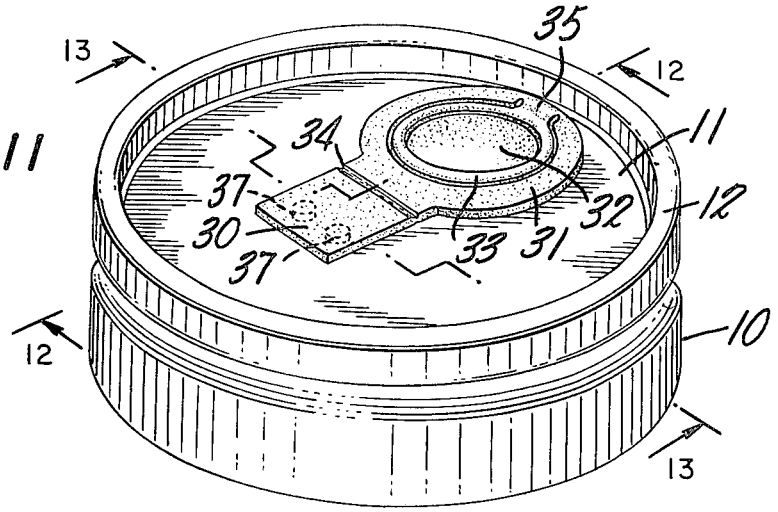
FIG. 11 is a perspective view of a container showing still another embodiment of the closure of the present invention.
Figure 12:
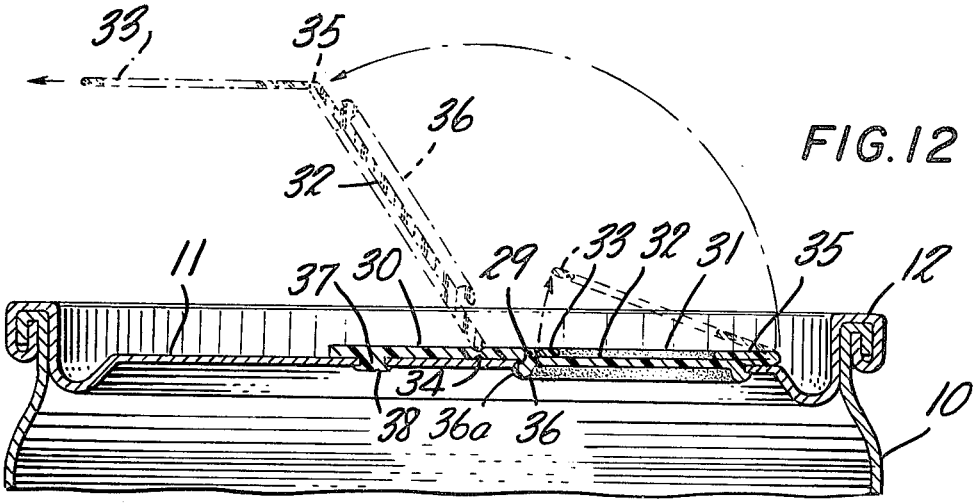
Figure 13:
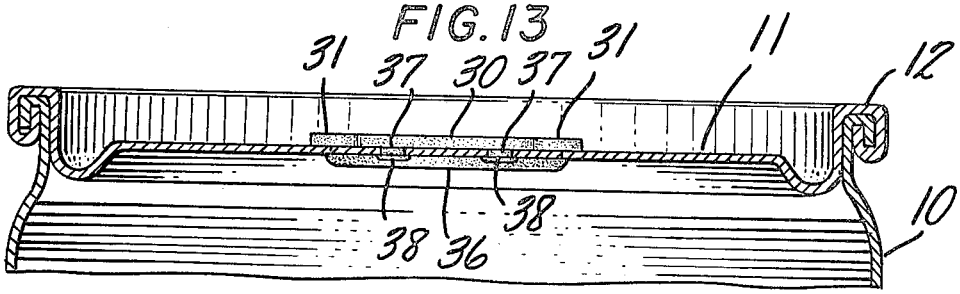
Figure 14:
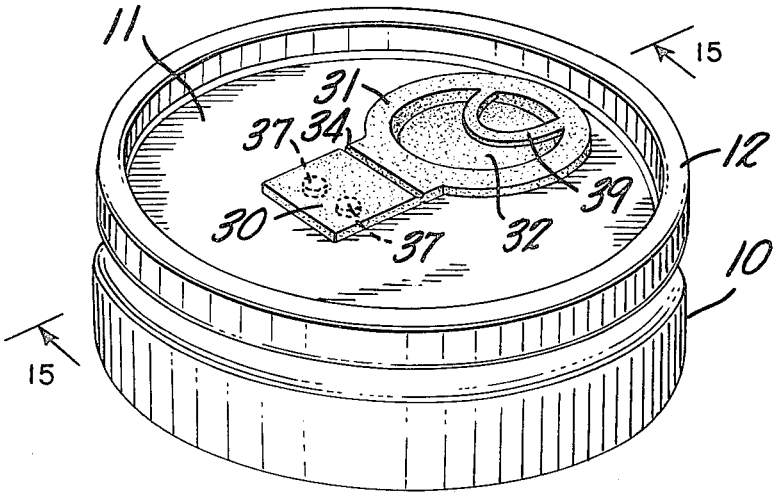
Figure 15:
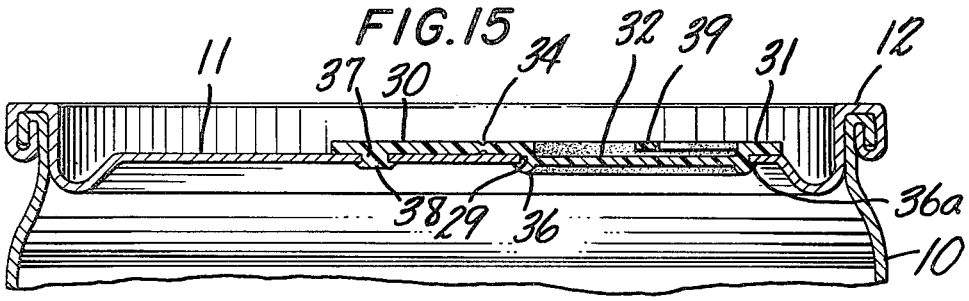
Figure 16:
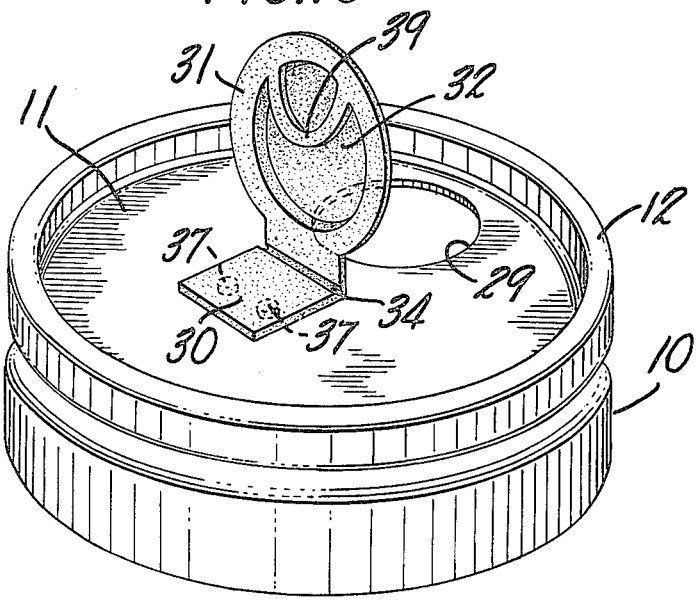

FIGS. 12 and 13 are sectional views taken along the lines 12—12 and 13—13, respectively, of FIG. 11 looking in the direction of the arrows;

FIG. 14 is a perspective view of still another embodiment of the closure of the present invention;

FIG. 15 is a sectional view taken along the line 15—15 of FIG. 14 looking in the direction of the arrows; and FIG. 16 is a perspective view showing the closure of FIG. 14 open.

Figure 1:
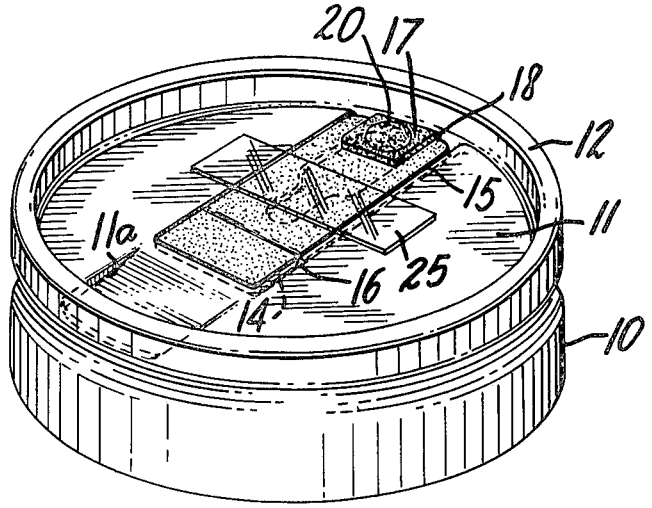
FIG. 1 is a perspective view of a container showing the closure of the present invention in sealed condition.
Figure 2:
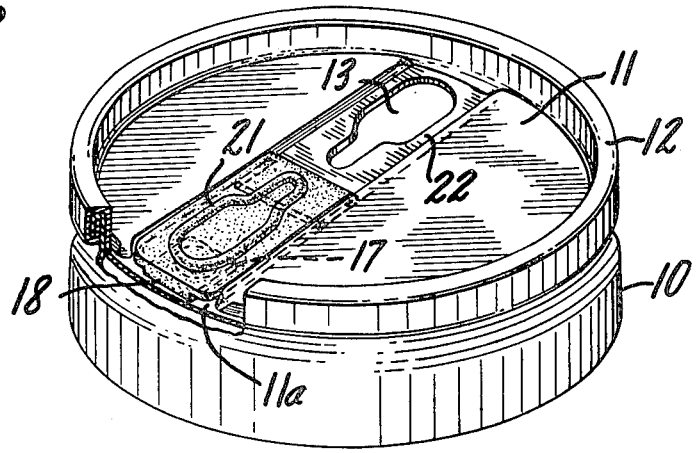
FIG. 2 is a view showing the closure in open position.

The articulated closure of the present invention is shown in FIGS. 1 and 2 applied to a conventional container which includes a cylindrical sidewall 10, an upper lid 11 joined to the upper end of the sidewall by a chime 12 and a bottom (not shown) of the same shape and diameter as the upper end to permit the containers to be stacked.

The lid 11 is recessed beneath the upper edge of the chime 12 and contains an opening 13 offset from the center of the lid. The opening 15 is preferably elongated in a substantially radial direction so that air can enter the container through the inner end while the contents are being discharged from the outer end. The opening can be divided into separate air inlet and pour openings, and the size of the opening can be dimensioned according to the contents to be poured therefrom. In the embodiment illustrated in FIG. 2, the outer end is wider than the inner end to increase the rate of flow of the contents poured through the opening. In the modified version illustrated in FIG. 3, the outer end of the opening 13*a* is considerably narrower to facilitate breaking the seal when opening the closure.

The opening 13 is normally sealed by the articulated closure of the present invention. The articulated closure, as shown in FIGS. 1 and 2, includes a mounting element 14, a closure element 15 connected to the mounting element 14 by a hinge connection 16 and a lift element 17 connected to the closure element by a hinge connection 18. The mounting element 14 is mounted to the lid of the container adjacent the inner end of the opening 13. The closure element normally overlies and seals the opening. The lift element 17, in the sealed condition of the container, is normally folded back along the hinge connection 18 in engagement with the upper surface of the closure element, but it can be lifted to upright position relative to the closure element to break the seal, lift the closure element from sealing engagement with the opening and pivot it along the hinge 16 to the open position shown in FIG. 2.

The lengths of the opening 13 and the closure element 15, in the embodiment illustrated in FIGS. 1 and 2, are such that the closure in open position folds back so that at least the outer end recesses into a recessed portion 11*a*. The parts are preferably dimensioned so that the end of the closure, in the open position shown in FIG. 2, interlocks with the recess 11*a* in the lid and/or on the inner surface of the chime 12 to hold the closure in fully open position while the contents are discharged from the container. This is advantageous in a beverage container when the contents are drunk directly from the open container.

The articulated closure is preferably made of a synthetic plastic material such as polypropylene or nylon, but it can also be made of metal, paperboard, plastic of a plastic covered base material. The hinges may be formed integrally with the closure by thinner gauge flexible bend lines, for example, by notching one or both sides of the material. These "living" hinges or bend lines should permit the closure element to pivot in the order of 180° from closed to open positions and the lift element 17 to pivot in the order of from 90° to 180° from the folded-back position on the closure element.

The lift element 17 of the articulated closure has an opening 19 in the center thereof which engages and interlocks with an upstanding stud 20 on the upper surface of the closure element. The lift element can also be maintained in folded-back interfacing relationship with the upper surface of the closure element by interengaging protruding and recessed formations on the interfacing surfaces or a pressure sensitive adhering material. In the preferred embodiment, the opening 19 provides a convenient means for gripping the lifting element.

The seal is preferably formed by a depending formation 21 made of thermoplastic material, preferably the same material as the closure, on the undersurface of the closure element. The depending formation 21 is shaped in complementary fashion to the opening so that when the closure element is pressed against the lid the depending formation 21 tightly engages the edge forming the opening.

In FIGS. 1 and 2, the lid is provided with a recess 22 of substantially the same shape and depth as the outer configuration and thickness of the mounting and closure elements 14, 15 lying end to end. By recessing the mounting element 14, a flat storage surface is provided for the closure element by the upper surfaces of the mounting element and the portion of the lid adjacent the mounting element when the closure and/or lift element is interlocked with the inner surface of the chime to hold the closure in open condition.

Figure 3:
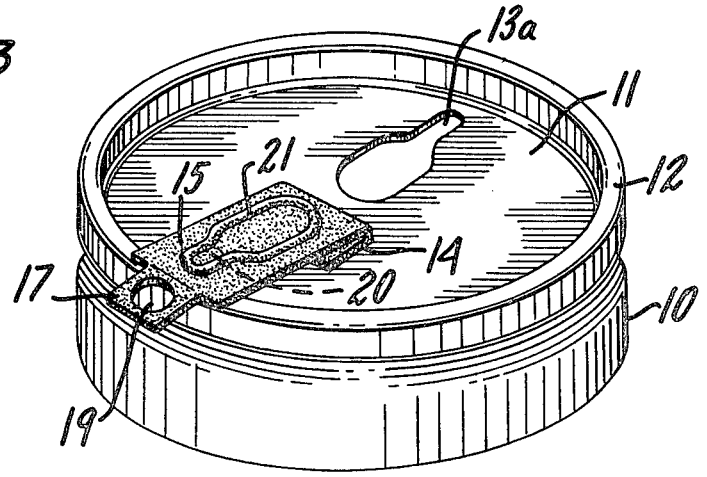
FIG. 3 is a view similar to FIG. 2 of another embodiment of the invention.

The articulated closure shown in FIG. 3 is the same as the one shown in FIGS. 1 and 2, except for the orientation of the pour opening 13*a* and the fact that the lid is shown flat without the recess 22 for the mounting element 14.

In FIGS. 4 through 6 the lid is provided with a recess 22*a* of substantially the same shape and depth as the outer configuration and thickness of the mounting element 14, and the recess 11*a* (FIG. 1) in the lid is eliminated so that a flat storage space is provided for the closure element by the upper surfaces of the mounting element and the lid substantially all the way to the chime. The hinge 16 in this embodiment is preferably elongated in the longitudinal direction of the closure to accommodate the mounting element 14 at the lower recessed level and the closure element 15 at the elevated level in interfacing relationship with the surface of the lid surrounding the pour opening. In the open, stored position of the closure element, the lift element 17 can be folded underneath the closure element, as shown in FIG. 2, or placed in the upstanding position illustrated in phantom lines in FIG. 6.

The articulated closure shown in FIGS. 7, 8 and 9 illustrates another embodiment of the articulated closure of the present invention in which the closure component 15' is shaped generally the same but larger than the configuration of the opening 13' to reduce the quantity of material utilized in making the closure. In addition, the mounting element 14' is of generally rounded configuration to eliminate the corners. The opening 13' is generally of the configuration of the opening shown in FIGS. 1 and 2, but the outer end thereof is provided with an outwardly extending nose formation 23 to combine the advantage of the openings 13, shown in FIGS. 1 and 2, 13*a*, shown in FIG. 3. That is to say, the opening 13' has an enlarged outer end to increase the rate of flow of the contents poured through that portion of the opening and narrower nose extremity to facilitate breaking the seal on lifting the closure element. The lift tab 17' is engageable with the upstanding stud 20' in the same manner as in the other embodiments described above.

In all of the embodiments described herein, the sealing of the depending formations 21, 21' is preferably achieved by thermoformation, although other conventional sealing techniques may be utilized. More specifically, when the closure element is pressed against the lid, the depending formation 21 will protrude slightly below the undersurface of the lid. The application of heat to the lower edge of the thermoplastic formation 21 at a temperature at least high enough to soften and spread the lower edge, about 275° F. or above for polypropylene, will cause the material to flow outwardly underneath the surface of the lid to form an effective seal 21*a*, as best shown in FIGS. 4, 5 and 6.

In the embodiment illustrated in FIGS. 7 through 9, the opening 13' is defined by a depending outwardly sloped lip 24 so that in this embodiment, as shown in FIGS. 8 and 9, the application of heat to the depending formation 21' causes the formation to spread outwardly toward the depending outwardly tapered edge of the lip 24 and around the bottom thereof to form the seal 21*a*'.

In the embodiment illustrated in FIG. 10 the upper surface of the lid is formed with a recess 22 to receive both the mounting and closure elements 14'' and 15'', respectively, and the lift element 17'' in the folded back condition is at least partly recessed at 26 in the upper surface of the closure element. Toward this end, the hinge element 18'' is somewhat elongated to permit the lift 17'' to be pressed into and interlocked within the complementary shaped recess 26 in the outer end of the upper surface of the closure element. The interlocking edges 27 of the lift element 17'' and recess 26 hold the lift element securely in folded-back position, thereby dispensing with the need for the provision of the interlocking means 19, 20 described above.

In the embodiment illustrated in FIGS. 11 through 13, the pour opening 29 in the lid is of generally circular configuration. The articulated closure includes a mounting element 30, a closure element 31 having a circular recess 32 formed in the upper surface thereof and a ring-shaped lift element 33 normally accommodated in the recess 32 of the closure element. The closure element is connected to the mounting element by a hinge connection 34. The lift element is integrally connected at 35 to the closure element, and that connection functions as a hinge to permit the ring-shaped lift element to be raised relative to the closure element, as indicated in phantom lines in FIG. 12. The upward pull on the ring breaks the seal at the end of the closure opposite the mounted end and lifts the closure element out of the pour opening by pivotal motion about the hinge connection 34, as shown in phantom lines in FIG. 12.

The closure element can be readily reclosed by reengaging it with the pour opening. In this connection, the recess 32 in the upper surface of the closure element not only provides a storage recess for the lift element 33, but the recess 32 provides a convenient thumb-engageable surface to facilitate reclosing the container.

The closure element 31 has a depending formation 36 of complementary shape to the pour opening so that when the closure element is pressed against the lid the depending formation tightly engages the edge forming the pour opening. This depending formation extends below the underside of the lid and is thermo-formed, as described above, to soften and spread the depending formation 36 so that a portion **36*a*** thereof protrudes and engages the underside of the lid surrounding the opening to form an effective seal.

The mounting element 30 can be anchored by any suitable means to the lid, but in the embodiment illustrated in FIGS. 11 through 13 the mounting element has a pair of depending leg formations 37 which are insertable into a pair of openings in the lid. After the depending formations have been inserted in the openings, enlargements 38 are thermo-formed on the lower ends of the depending formations to lock the mounting element in place on the lid. The forming of the sealing portions **36*a* and the enlargements 38 can be accomplished simultaneously by subjecting the depending formations 36 and 37 to the stepped heating surface of a single heating element. Needless to say, suitable adhesive mounting means can be used in conjunction with or in lieu of the depending leg formation 37**.

The closure element 31, as described above, includes a peripheral portion and a central depending recessed portion which accommodates the ring-shaped lift element 33 therein. The peripheral portion of the closure engages the upper surface of the lid surrounding the pour opening, and this peripheral portion may or may not be sealed to the upper surface of the lid. Preferably a frangible sealing film is applied to the underside of the lid as described below.

A modified version of the articulated closure just described is shown in FIGS. 14, 15 and 16 in which the lift element 39 is a curved formation integrally connected at opposite ends to the closure element opposite the mounting end. The lift element 39 is accommodated within the recessed portion 32 of the closure element and spaced above the bottom of the recess so that it can be gripped and lifted relative to the closure element, the ends of the curved lift element serving as hinge connections between it and the closure element.

A supplemental seal 25, shown in FIG. 1, can be provided as assurance to the customer that the closure has not been opened. The seal 25 is preferably a frangible transparent strip which extends transversely of the closure across the closure element and is effectively and permanently bonded to the upper surface of the lid and, if desired, to the closure element itself. It is applicable to all of the embodiments of the invention as a guaranty of the integrity of the container.

Other sealing arrangements can be employed if desirable. For example, a seal may be provided between the interfacing surfaces of the underside of the closure element and the upper surface of the lid surrounding the pour opening. In addition, the depending formation 21 may be eliminated and a continuous plastic coating may be applied across the undersurface of the lid surrounding the opening and across the opening itself. Needless to say, the seal will be broken when the closure element is lifted. In applications where a hermetic seal may not be necessary, the depending formation 21 may be shaped to provide a snap locking engagement with the edge defining the opening in the lid. To insure the integrity of the container when subjected to internal pressures on the order of 90 psi, or when subjected to atmospheric pressure with the contents of the container under vacuum, the sealing materials are selected of suitable plastic materials with appropriate resilience to perform their function.

The articulated closure of the present invention can be preassembled on discrete insert, for example, of the type shown in FIG. 9 of my U.S. Pat. No. 4,077,528, and the insert mounted in the opening. In such case, the articulated closure would be mounted on the upper flange thereof before the insert is mounted in the opening on the lid of the container.

The invention has been shown and described in preferred forms and by way of example only, and different variations and modifications can be made therein within the spirit of the invention. This invention, therefore, is not intended to be limited to form or embodiment except in so far as such limitations are expressly set forth in the claims.

I claim:

1. In a container having a lid and a pour opening in the lid for the discharge of the contents of the container, an articulated closure for the opening comprising a mounting element on the lid adjacent the inner end of the opening, a relatively rigid closure element hinged to the mounting element for overlying the opening to seal the contents within the container, a lift element integrally formed with the closure element on the end opposite the mounting element and liftable relative to the closure element to break the seal and lift the closure element away from the lid along the hinged connection between the mounting and closure elements, depending means integrally formed from the underside of the mounting element to mount the mounting element to the lid and interlocking with the lid to prevent rotational movement of the mounting element relative to the lid, an opening in the lid to accommodate the depending means and enlargement means integrally formed on the depending means beneath the opening in the lid to anchor the mounting element thereon.

2. A container as set forth in claim 1 in which said depending means includes at least a pair of depending legs and in which said opening includes an opening in the lid for each leg.

3. A container as set forth in claim 2 in which the upper surface of the closure element is recessed and the lift element extends from the end of the closure element opposite the mounting element overlying the recessed portion of the closure element.

4. A container as set forth in claim 2 in which both the pour opening in the lid and the closure element are substantially circular and in which the closure element includes a peripheral portion which engages the upper surface of the lid surrounding the pour opening, a central depending recessed portion with the peripheral portion which engages the pour opening and a thermoformed sealing portion integrally formed with the central depending recessed portion around the outer periphery of the central depending recessed portion which engages the underside of the lid surrounding the pour opening and is lifted upwardly through the pour opening when the closure element is lifted.

5. A container as set forth in claim 3 in which the lift element includes a ring integrally connected to the closure element opposite the mounting element and normally recessed in the upper surface of the closure element.

6. A container as set forth in claim 3 in which the lift element includes a liftable finger gripping portion within the recessed portion of the closure element and spaced above the bottom thereof.

* * * * *

UNITED STATES PATENT AND TRADEMARK OFFICE

CERTIFICATE OF CORRECTION

PATENT NO. : 4,232,797
DATED : November 11, 1980
INVENTOR(S) : Nelson J. Waterbury It is certified that error appears in the above—identified patent and that said Letters Patent is hereby corrected as shown below:

Column 1, line 20, "tap" should read --tab--;

Column 2, line 52, "15" should read --13--;

Column 7, line 15, "with" should read --within--.

Signed and Sealed this

*Seventeenth* Day of *March 1981*

[SEAL]

*Attest:*

RENE D. TEGTMEYER

*Attesting Officer* *Acting Commissioner of Patents and Trademarks*